US009514671B2

(12) United States Patent
Park

(10) Patent No.: US 9,514,671 B2
(45) Date of Patent: Dec. 6, 2016

(54) POWER SUPPLY UNIT AND ORGANIC LIGHT EMITTING DISPLAY INCLUDING THE SAME

(75) Inventor: Sung-Cheon Park, Yongin (KR)

(73) Assignee: Samsung Display Co., Ltd., Gyeonggi-do (KR)

( * ) Notice: Subject to any disclaimer, the term of this patent is extended or adjusted under 35 U.S.C. 154(b) by 295 days.

(21) Appl. No.: 13/536,248

(22) Filed: Jun. 28, 2012

(65) Prior Publication Data

US 2013/0235017 A1 Sep. 12, 2013

(30) Foreign Application Priority Data

Mar. 7, 2012 (KR) ..... 10-2012-0023349

(51) Int. Cl.

| | |
|---|---|
| ***G05F 1/00*** | (2006.01) |
| ***G09G 3/32*** | (2016.01) |
| *G05F 1/40* | (2006.01) |
| *G05F 1/62* | (2006.01) |

(52) U.S. Cl.

CPC ..... *G09G 3/3208* (2013.01); *G05F 1/40* (2013.01); *G05F 1/62* (2013.01); *G09G 2330/028* (2013.01)

(58) Field of Classification Search

CPC ..... G05F 1/40; G05F 1/62; G05F 1/00
USPC ..... 345/82; 323/282, 285, 287
See application file for complete search history.

(56) References Cited

U.S. PATENT DOCUMENTS

| | | | | |
|---|---|---|---|---|
| 4,278,930 A | | 7/1981 | Rogers | |
| 4,929,882 A | * | 5/1990 | Szepesi | 323/222 |
| 5,041,777 A | | 8/1991 | Riedger | |
| 5,642,034 A | | 6/1997 | Amano | |
| 5,731,694 A | * | 3/1998 | Wilcox et al. | 323/287 |
| 5,912,552 A | * | 6/1999 | Tateishi | 323/285 |

(Continued)

FOREIGN PATENT DOCUMENTS

| | | |
|---|---|---|
| EP | 0 421 516 | 9/1990 |
| KR | 1020070000144 A | 1/2007 |

(Continued)

OTHER PUBLICATIONS

Burr-Brown Application Bulletin, "Implementation and Applications of Current Sources and Current Receiver", Mar. 1990,pp. 1-30.*

Search Report dated Jun. 14, 2013 in European Patent Application No. 12185893.0, which claims priority to Korean priority application No. 10-2012-0023349.

(Continued)

*Primary Examiner* — Chanh Nguyen
*Assistant Examiner* — Yuzhen Shen
(74) *Attorney, Agent, or Firm* — Knobbe Martens Olson & Bear LLP

(57) ABSTRACT

Disclosed is a power supply unit including a DC-DC converter including an output terminal and resistor coupling terminal and an external resistor coupled to the resistor coupling terminal, where the DC-DC converter includes a first power generation unit which outputs a predetermined current to the output terminal, and a sensing circuit unit that includes a sensing resistor located between the first power generation unit and the output terminal and stops an operation of the first power generation unit depending on a current value flowing in the sensing resistor. A power supply unit and an organic light emitting display including the power supply unit include a sensing circuit unit that stops operation of the power supply unit to prevent an additional damage when an abnormal current occurs.

12 Claims, 4 Drawing Sheets

(56) References Cited

U.S. PATENT DOCUMENTS

| | | | | |
|---|---|---|---|---|
| 6,028,755 | A | 2/2000 | Saeki et al. | |
| 6,185,082 | B1 | 2/2001 | Yang | |
| 7,589,514 | B1 * | 9/2009 | Fernald | 324/76.11 |
| 8,334,824 | B2 * | 12/2012 | Park | 345/82 |
| 2002/0180418 | A1 * | 12/2002 | Jones et al. | 324/118 |
| 2006/0171178 | A1 * | 8/2006 | Shvarts | H02J 1/10 363/65 |
| 2008/0174287 | A1 * | 7/2008 | Park | 323/271 |
| 2009/0225478 | A1 | 9/2009 | Kido et al. | |

FOREIGN PATENT DOCUMENTS

| | | | |
|---|---|---|---|
| KR | 1009990631 | B1 | 12/2010 |
| KR | 1020110086977 | A | 8/2011 |
| TW | 201201183 | | 1/2012 |

OTHER PUBLICATIONS

PowTech, "Universal High Brightness LED Driver" XP-002678162, China Resources Powtech (Shanghai) Limited, PT4207_DSB_Rev EN_0.2, pp. 1-6.

"Power-Sensing Circuit Breaker Breaks New Ground", Dec. 22, 2005, http://www.maximintergrated.com/app-notes/index.mvp/id/3669.

Ferreira, et al., "Multistage Differential Amplifiers", Mar. 2004, pp. 1-42, FEUP Universidade do Porto Faculdade de Engenharia.

"Other OP-Amp Ideas", May 29, 2013, http://www.eecs.tufts.edu/~dsculley/tutorial/opamps/opamps7.html.

Office Action dated May 6, 2016 in corresponding Taiwan Patent Application No. 101134743.

R.M. Stitt, "Implementation and Applications of Current Sources and Current Receivers," Burr-Brown Application Bulletin AB165, Burr-Brown Corporation, Mar. 1990, pp. 1-30.

* cited by examiner

POWER SUPPLY UNIT AND ORGANIC LIGHT EMITTING DISPLAY INCLUDING THE SAME

CROSS-REFERENCE TO RELATED APPLICATIONS

This application claims priority to and the benefit of Korean Patent Application No. 10-2012-0023349, filed on Mar. 7, 2012, in the Korean Intellectual Property Office, the entire content of which is incorporated herein by reference.

BACKGROUND

Field

The present disclosure relates to a power supply unit and an organic light emitting display including the same that includes a sensing circuit unit, thereby stopping an operation of the power supply unit to prevent an additional damage when an abnormal current occurs.

Description of the Related Technology

Recently, various flat panel displays capable of reducing weight and volume, which are disadvantages of a cathode ray tube, have been developed. Examples of the displays include Liquid Crystal Display (LCD), Field Emission Display (FED), Plasma Display Panel (PDP), Organic Light Emitting Display (OLED), and the like.

Among the flat panel displays, the organic light emitting display device, which displays an image using an organic light emitting diode generating light by recombination between an electron and a hole, has advantages in that it has a rapid response speed and is driven at low power.

Typically, the organic light emitting display (OLED) is classified into a passive matrix OLED (PMOLED) and an active matrix OLED (AMOLED), depending on the driving system of the organic light emitting element.

The active matrix OLED (AMOLED) includes a plurality of scan lines, a plurality of data lines, and a plurality of pixels which are coupled to the lines and arranged in form of a matrix.

The organic light emitting display includes the power supply unit which generates powers required for driving the pixels by converting an external power.

The power supply unit supplies the generated powers to the pixels for displaying the image through the power line.

However, the power lines can be short-circuited with each other or with other lines due to the deflection during manufacturing or failure during the use. Therefore, if the power supply unit is continued to be driven despite the short-circuit, additional damage such as fire may occur.

SUMMARY OF CERTAIN INVENTIVE ASPECTS

Therefore, an object of the present invention is to provide a power supply unit and an organic light emitting display including the same that includes a sensing circuit unit, thereby stopping an operation of the power supply unit to prevent an additional damage when an abnormal current occurs.

Another object of the present invention is to provide a power supply unit and an organic light emitting display including the same that can easily adjust a value of the abnormal current by changing only a resistance value of an external resistor even if a DC-DC converter is implemented using an integrated circuit chip.

According to one embodiment, there is provided a power supply unit including: a DC-DC converter including a first power generation unit, an output terminal, a sensing circuit unit between the first power generation unit and the output terminal, and a resistor coupling terminal, where the sensing circuit includes a sensing resistor; and an external resistor coupled to the resistor coupling terminal, where the first power generation unit is configured to output a current to the output terminal, the sensing circuit unit is configured to cause a stop in operation of the first power generation unit based on a value of a current flowing in the sensing resistor exceeding a predetermined value, where the output terminal is configured to output a first power.

In addition, the sensing circuit unit may further include a first resistor connected between a common node of the first power generation unit and the sensing resistor and a first node, a first transistor connected between the first node and the resistor coupling terminal, an operational amplifier configured to control the first transistor using an input reference voltage and a voltage input to the first node, and a comparator configured to supply a driving stop signal to the first power generation unit if both a voltage of the output terminal and a voltage input to the first node which are identical.

In addition, the operational amplifier may include a non-inverting terminal with the reference voltage input thereto, an inverting terminal with the voltage of the resistor coupling terminal input thereto, and an output terminal connected to a gate electrode of the first transistor.

In addition, the sensing circuit unit may further include a first resistor connected between a common node of the first power generation unit and the sensing resistor and a first node, a first transistor connected between the first node and a first reference current source, a second resistor connected between the output terminal and a second node, a second transistor connected between the second node and a second reference current source, a third transistor connected between the first node and the resistor coupling terminal and having a gate electrode connected to a common node of the first transistor and the first reference current source, and a comparator configured to supply a driving stop signal to the first power generation unit if both a reference voltage and a voltage input to the resistor coupling terminal are identical.

In addition, the second transistor may include a gate electrode coupled to a gate electrode of the first transistor and to the second reference current source.

In addition, the first resistor and the second resistor may have the same resistance.

In addition, the first transistor and the second transistor may be P-type transistors.

In addition, the third transistor may be N-type transistor.

In addition, a current value supplied by the first reference current source and a current value supplied by the second reference source may be identical.

In addition, the DC-DC converter may further include an input terminal electrically coupled to a power unit.

In addition, the power supply unit may further include a first inductor connected between the power unit and the input terminal.

In addition, the first power generation unit may include a fourth transistor connected between the input terminal and a ground power, a fifth transistor connected between the input terminal and the sensing resistor, and a first switching control unit configured to control the fourth transistor and the fifth transistor.

In addition, the DC-DC converter may be implemented using an integrated chip.

According to another embodiment of the present invention, there is provided an organic light emitting display including: a plurality of pixels supplied with each of a scan signal, a data signal and a first power; a scan driving unit for supplying the scan signal to the pixels through a scan line; a data driving unit for supplying the data signal to the pixels a data line; and a power supply unit that includes a DC-DC converter including a first power generation unit, an output terminal, a sensing circuit unit between the first power generation unit and the output terminal, a resistor coupling terminal, and an external resistor coupled to the resistor coupling terminal, the first power generation unit configured to output a current to the output terminal, the sensing circuit unit including a sensing resistor and configured to cause a stop in operation of the first power generation unit based on a value of a current flowing in the sensing resistor exceeding a predetermined value, the output terminal configured to output the first power, the resistor coupling terminal configured to supply the first power to the pixels.

In addition, the sensing circuit unit may further include a first resistor connected between a common node of the first power generation unit and the sensing resistor and a first node, a first transistor connected between the first node and the resistor coupling terminal, an operational amplifier configured to control the first transistor using a reference voltage and a voltage of the first node which are input, and a comparator configured to supply a driving stop signal to the first power generation unit if a voltage input to the output terminal and a voltage input to the first node are identical.

In addition, the operational amplifier may include a non-inverting terminal having the reference voltage input thereto, an inverting terminal having the voltage of the resistor coupling terminal input thereto, and an output terminal connected to a gate electrode of the first transistor.

In addition, the sensing circuit unit may further include a first resistor connected between a common node of the first power generation unit and the sensing resistor and a first node, a first transistor connected between the first node and a first reference current source, a second resistor connected between the output terminal and a second node, a second transistor connected between the second node and a second reference current source, a third transistor connected between the first node and the resistor coupling terminal and having a gate electrode connected to a common node of the first transistor and the first reference current source, and a comparator configured to supply a driving stop signal to the first power generation unit if an input reference voltage and a voltage input to the resistor coupling terminal are identical.

In addition, the second transistor may include a gate electrode coupled to a gate electrode of the first transistor and the second reference current source.

In addition, the first resistor and the second resistor may have the same resistance.

In addition, the first transistor and the second transistor may be P-type transistors.

In addition, the third transistor may be N-type transistor.

In addition, the current value supplied by the first reference current source and the current value supplied by the second reference source may be identical.

In addition, the DC-DC converter may further include an input terminal electrically coupled to a power unit.

In addition, the organic light emitting display may further include a first inductor connected between the power unit and the input terminal.

In addition, the first power generation unit may include a fourth transistor connected between the input terminal and a ground power, a fifth transistor connected between the input terminal and the sensing resistor, and a first switching control unit configured to control the fourth transistor and the fifth transistor.

In addition, the DC-DC converter may be implemented using an integrated chip.

BRIEF DESCRIPTION OF THE DRAWINGS

The accompanying drawings, together with the specification, illustrate some embodiments of the present invention, and, together with the description, serve to explain the principles of the present invention.

DETAILED DESCRIPTION OF CERTAIN INVENTIVE EMBODIMENTS

Figure 1:
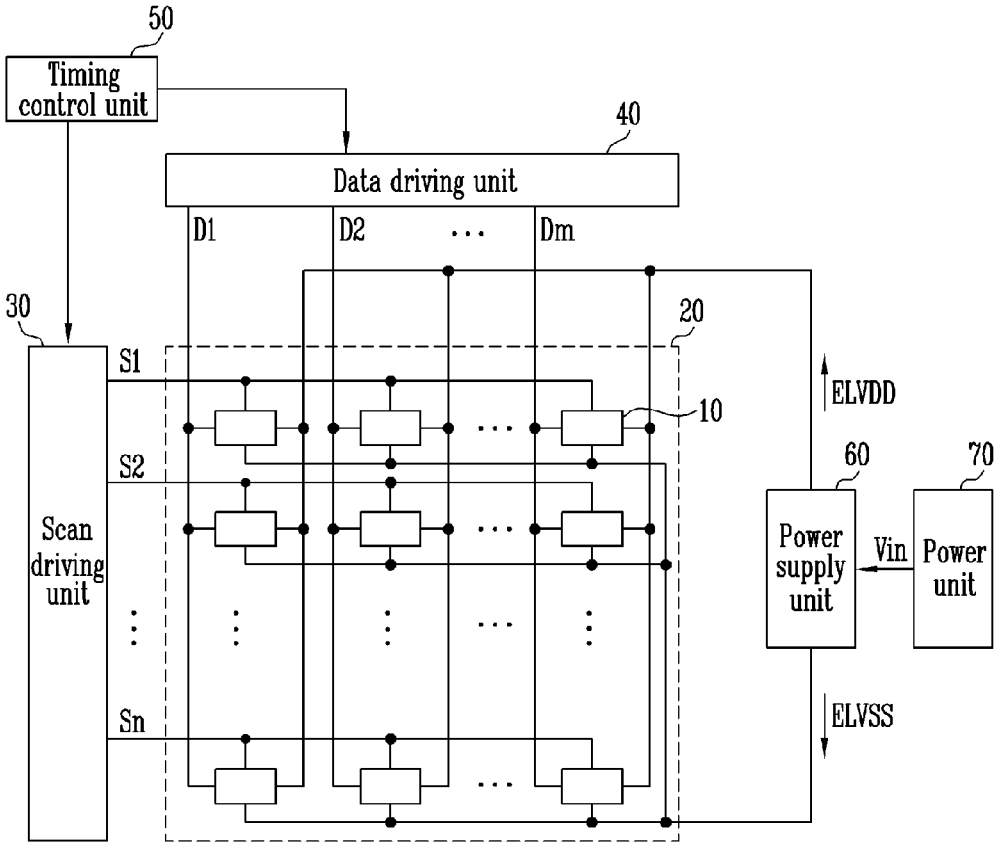
FIG. 1 is a diagram illustrating an embodiment of an organic light emitting display.

Hereinafter, certain embodiments according to the present invention will be described with reference to the accompanying drawings. When a first element is described as being coupled to a second element, the first element may be not only directly coupled to the second element but may also be indirectly coupled to the second element via a third element. Further, some of the elements that are not essential to the complete understanding of the invention are omitted for clarity. Also, like reference numerals generally refer to like elements throughout.

Details of some embodiments are included in the detailed description and drawings.

Features and advantages of the present invention, and methods for achieving the above will be apparent with reference to the embodiments that are described below in detail together with the accompanying drawings. However, the present invention is not limited to the embodiments disclosed below, but can be implemented in various forms.

FIG. 1 is diagram illustrating an embodiment of the organic light emitting display.

Referring to FIG. 1, the organic light emitting display includes a pixel unit 20 including the pixels 10 connected to the scan lines S1 through Sn and data lines D1 through Dm, a scan driving unit 30 for supplying the scan signal to each pixel 10 via the scan lines S1 through Sn, a data driving unit 40 for supplying the data signal to each pixel 10 via the data lines D1 to Dm, and a power supply unit 60 for supplying a first power ELVDD and a second power ELVSS to each pixel 10 via the power lines, and further includes a timing control unit 50 for controlling the scan driving unit 30 and the data driving unit 40.

Each of the pixels 10 supplied with the first power ELVDD and the second power ELVSS from the power supply unit 60 generate, via an organic light emitting diode, a light corresponding to the data signal by a current flowing from the first power ELVDD to the second power ELVSS.

The scan driving unit 30 generates the scan signals by control of the timing control unit 50 and supplies the generated scan signals to the scan lines S1 through Sn.

The data driving unit 40 generates the data signals by control of the timing control unit 50 and supplies the generated data signals to the data lines D1 through Dm.

As the scan signals are sequentially supplied to the scan lines S1 through Sn, the pixels 10 are sequentially selected for each of lines, and the data signals transmitted from the data lines D1 through Dm are supplied to the selected pixels 10.

Figure 2:
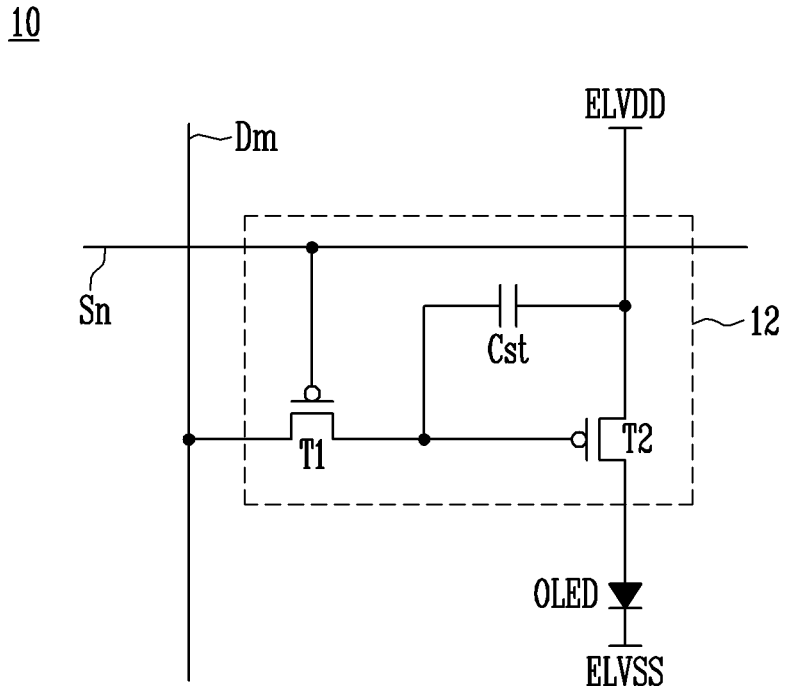
FIG. 2 is a diagram illustrating an embodiment of the pixels shown in FIG. 1.

FIG. 2 is a diagram illustrating one embodiment of the pixels shown in FIG. 1. FIG. 2 shows a pixel connected to n-th scan line Sn and m-th data line Dm for convenience of description.

Referring to FIG. 2, each pixel 10 includes the organic light emitting diode OLED, and a pixel circuit 12 for controlling the organic light emitting diode OLED which is connected to the data line Dm and the scan line Sn.

An anode electrode of the organic light emitting diode OLED is connected to the pixel electrode 12, and a cathode electrode thereof is connected to the second power ELVSS.

The organic light emitting diode OLED generates a light having a predetermined luminance depending on the current supplied from the pixel circuit 12.

The pixel circuit 12 controls an amount of current supplied to the organic light emitting diode OLED depending on the data signal supplied to the data line Dm when the scan signal is supplied to the scan line Sn. For this purpose, the pixel circuit 12 includes a second transistor T2 connected between the first power ELVDD and the organic light emitting diode OLED, a first transistor T1 connected between the second transistor T2, the data line Dm and the scan line Sn, and a storage capacitor Cst connected between a gate electrode and a first electrode.

The gate electrode of the first transistor T1 is connected to the scan line Sn and the first electrode of the first transistor T1 is connected to the data line Dm. Also, a second electrode of the first transistor T1 is connected to one side terminal of the storage capacitor Cst. The first electrode is set to either a source electrode or a drain electrode, and the second electrode is set to the other of the source or drain electrode. In some embodiments, if the first electrode is set to the source electrode, the second electrode is set to the drain electrode.

The first transistor T1 connected to the scan line Sn and the data line Dm is turned on when the scan signal is supplied from the scan line Sn, and then supplies the data signal supplied from the data line Dm to the storage capacitor Cst. The storage capacitor Cst is thus charged with a voltage corresponding to the data signal.

The gate electrode of the second transistor T2 is connected to one side terminal of the storage capacitor Cst, and the first electrode of the second transistor T2 is connected to the other side terminal of the storage capacitor Cst and the first power ELVDD. Also, the second electrode of the second transistor T2 is connected to the anode electrode of the organic light emitting diode OLED.

The second transistor T2 controls an amount of current flowing from the first power ELVDD to the second power ELVSS via the organic light emitting diode OLED depending on a value of voltage stored in the storage capacitor Cst. The organic light emitting diode OLED generates a light corresponding to the amount of current supplied from the second transistor T2.

The pixel configuration of FIG. 2 as described above is merely one embodiment of the present invention, and the pixel 10 of the present invention is not limited to the pixel configuration as described above. The pixel circuit 12 has a circuit configuration capable of supplying the current to the organic light emitting diode OLED, and may be selected in any one of currently known various configurations.

Returning to FIG. 1, the power supply unit 60 is supplied with an input power Vin from a power unit 70, and then converts the input power Vin to generate the first power ELVDD and the second power ELVSS supplied to each pixel 10.

In some embodiments, the first power ELVDD is set to a positive polarity voltage, and the second power ELVSS is set to a negative polarity voltage.

The power unit 70 may be a battery supplying a direct current power to the power supply unit 60, or a rectifier device converting an alternating current power to a direct current power and outputting the converted power, or another type of power unit.

Figure 3:
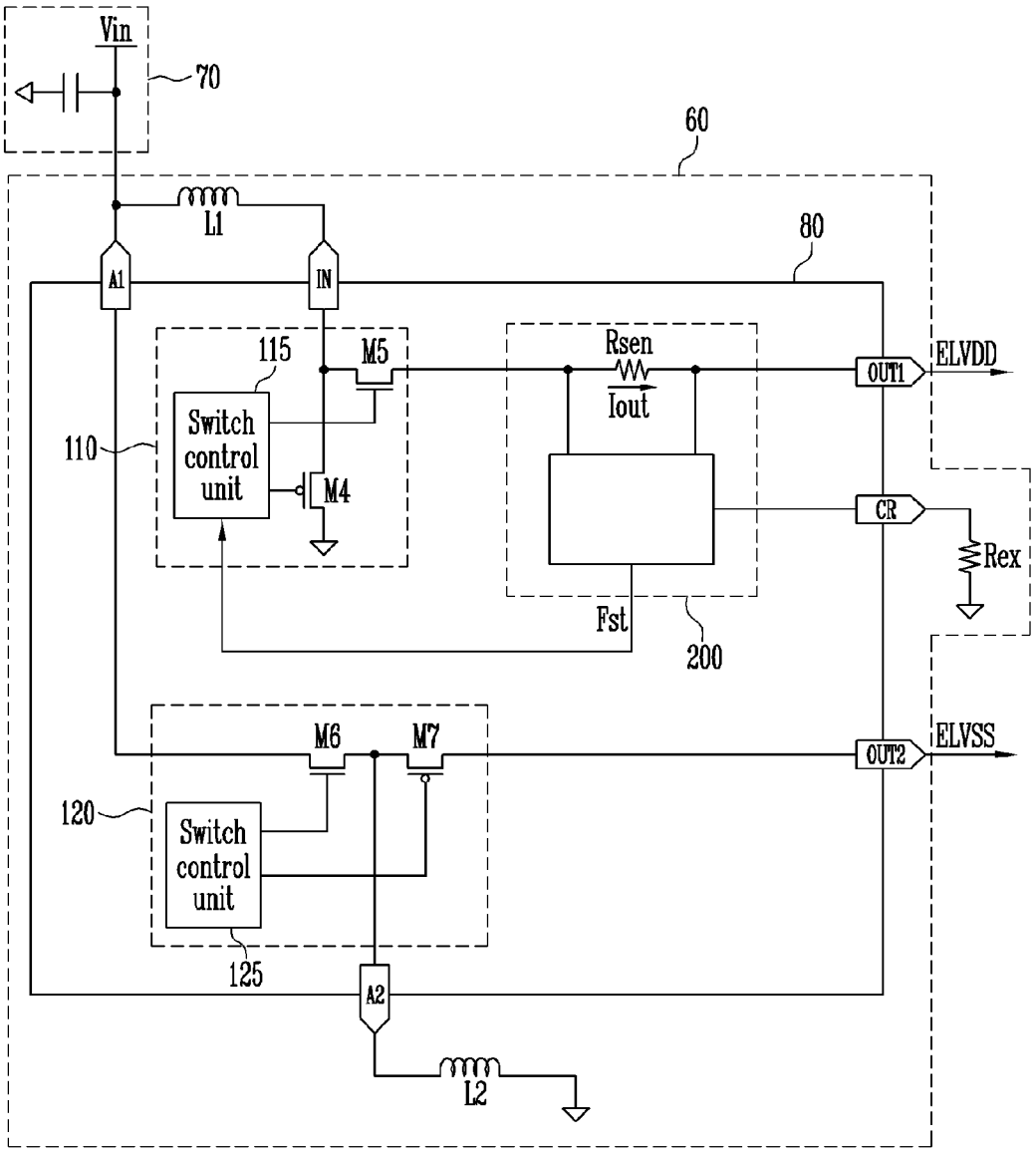
FIG. 3 is a diagram illustrating an embodiment of the power supply unit shown in FIG. 1.

FIG. 3 is a diagram illustrating an embodiment of the power supply unit shown in FIG. 1.

Referring to FIG. 3, an embodiment of the power supply unit 60 includes a DC-DC converter 80 and an external resistor Rex.

The DC-DC converter 80 generates the first power ELVDD using the input power Vin, and can include an output terminal OUT1 for outputting the first power ELVDD, a resistor coupling terminal CR coupled to the external resistor Rex, and an input terminal IN electrically coupled to the power unit 70.

The DC-DC converter 80 may be implemented using an integrated chip (IC Chip). The external resistor Rex located outside the DC-DC converter 80 can be connected to the resistor coupling terminal CR, and a first inductor L1 located outside the DC-DC converter 80 can be connected to the input terminal IN.

In addition, the DC-DC converter 80 can include a first power generation unit 110 and a sensing circuit unit 200.

The power generation unit 110 converts the voltage of the input power Vin to generate the first power ELVDD, and outputs the generated first power ELVDD to the output terminal OUT1 of the DC-DC converter 80.

The sensing circuit unit 200 includes a sensing resistor Rsen located between the first power generation unit 110 and the output terminal OUT1, and can stop operation of first power generation unit 110 depending on a value of current Iout flowing in the sensing resistor Rsen.

If the magnitude of the current Iout flowing in the sensing resistor Rsen is at a predetermined value, it is considered as abnormal in the display, and operation of the first power generation unit 110 is therefore stopped.

The sensing circuit unit 200 may output a driving stop signal Fst to the first power generation unit 110 in order to stop operation of the first power generation unit 110.

Referring to FIG. 3, the first power generation unit 110 includes a fourth transistor M4, a fifth transistor M5, and a first switch control unit 115.

The fourth transistor M4 is coupled between the input terminal IN and the ground power, and the fifth transistor M5 is coupled between the input terminal IN and the sensing resistor Rsen.

The first switch control unit 115 controls the fourth transistor M4 and the fifth transistor M5. In addition, the first switch control unit 115 converts the input power Vin to the first power ELVDD having the desired voltage level by controlling the on-off operations of the fourth transistor M4 and the fifth transistor M5.

The first inductor L1 is connected between the power unit 70 and the input terminal IN.

The fourth transistor M4 and the fifth transistor M5 can be alternately turned on, and therefore can be formed of different conductor types. As an example, if the fourth transistor M4 is formed of a P-type conductor, then the fifth transistor M5 can be formed of an N-type conductor.

In addition, if the driving stop signal Fst is transmitted from the sensing circuit unit 200, then the first switch control unit 115 can stop the operation of the first power generation unit 110 by holding both the fourth transistor M4 and the fifth transistor M5 in off states.

In addition, the DC-DC converter 80 can further include a second power generation unit 120 for generating the second power ELVSS.

The second power generation unit 120 can output the second power ELVSS through a separate output terminal OUT2.

In addition, the input power Vin can be input to the second power generation unit 120 from the power unit 70 through a power input terminal A1, and the second power generation unit 120 is coupled to the second inductor L2 located outside the DC-DC converter 80 through an inductor connection unit A2.

Referring to FIG. 3, the second power generation unit 120 can include a sixth transistor M6, a seventh transistor M7, and a second switch control unit 125.

The sixth transistor M6 can be coupled between the power input terminal A1 and inductor coupling terminal A2, and the seventh transistor M7 can be coupled between the inductor coupling terminal A2 and the output terminal OUT2.

The second switch control unit 125 controls the sixth transistor M6 and the seventh transistor M7. In addition, the second switching control unit 125 can convert the input power Vin to the second power (ELVSS) having the desired voltage level by controlling the on-off states of the sixth transistor M6 and the seventh transistor M7.

The second inductor L2 can be electrically coupled to the second power generation unit 120 by connecting to the inductor coupling terminal A2.

The sixth transistor M6 and the seventh transistor M7 can be alternatively turned on, and therefore can be formed of different conductor types. As an example, if the sixth transistor M6 is formed of an N-type conductor, then the seventh transistor M7 can be formed of a P-type conductor.

The configurations of the first power generation unit 110 and the second power generation unit 120 as described above are merely an embodiment for implementing the present invention, and therefore the present invention is not limited thereto.

Figure 4:
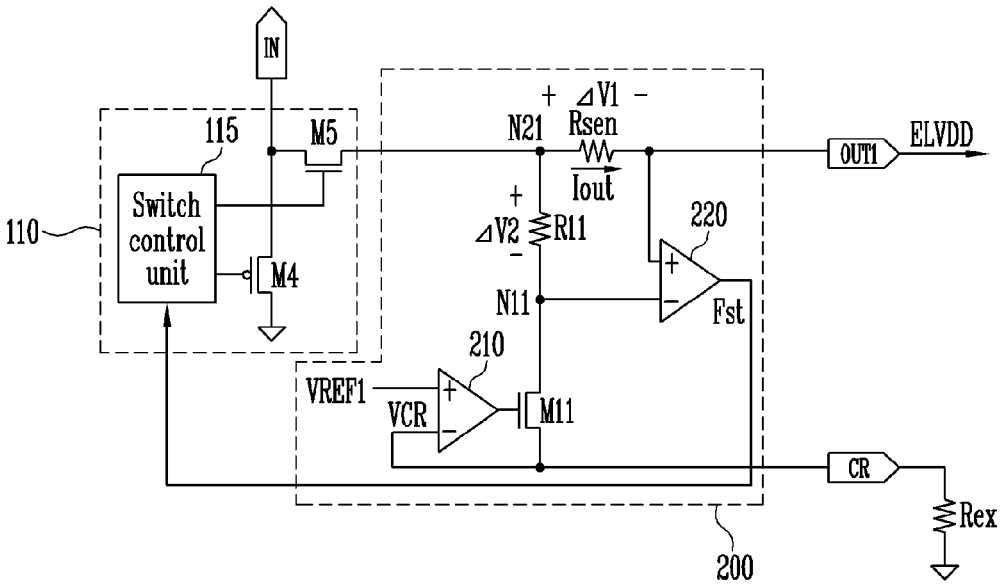
FIG. 4 is a diagram illustrating an embodiment of the sensing circuit unit shown in FIG. 3.

FIG. 4 is a diagram illustrating an embodiment of the sensing circuit unit shown in FIG. 3.

Referring to FIG. 4, an embodiment of the sensing circuit unit 200 includes a sensing resistor Rsen, a first resistor R11, a first transistor M11, an operational amplifier 210, and a comparator 220.

The sensing resistor Rsen is placed between the first power generation unit 110 and the output terminal of the DC-DC converter 80. Specifically, the sensing resistor Rsen is coupled to the fifth transistor M5 included in the first power generation unit 110.

The first resistor R11 is connected between second node N21, which is a common node between the first power generation unit 110 and the sensing resistor Rsen, and a first node N11.

The first transistor M11 is connected between the first node N11 and the resistor coupling terminal CR. The first transistor M11 can be coupled to the external resistor Rex via the resistor coupling terminal CR.

The reference voltage VREF1 and the voltage of the resistor coupling terminal CR are input to the operational amplifier 210 in order to control the first transistor M11.

The reference voltage VREF1 may be input to a non-inverting input terminal of the operational amplifier 210 and the voltage VCR of the resistor coupling terminal CR may be input to an inverting input terminal coupled to the resistor coupling terminal CR. In addition, the output terminal of the operational amplifier 210 may be connected to the gate electrode of the first transistor M11.

The voltage ELVDD of the output OUT11 and a voltage VN11 of the first node N11 are input to the comparator 220, and then, if both voltages are identical, then the comparator 220 can supply the driving stop signal Fst to the first power generation unit 110.

A first voltage Δ V1 across the sensing resistor Rsen and a second voltage Δ V2 across the first resistor R11 are identical, then the comparator 220 can supply the driving stop signal Fst to the first power generation unit 110.

Referring to the circuit configuration of FIG. 4, the first voltage Δ V1 and the second voltage Δ V2 are expressed as follows:

$$\Delta V1 = Iout \times Rsen$$

$$\Delta V2 = \frac{VREF1}{Rex} \times R11$$

The voltage ELVDD of the output terminal OUT1 and the voltage (VN11) of the first node N11 are identical means that the first voltage Δ V1 and the second voltage Δ V2 are identical, thus the above two equations can be expressed as follows:

$$\frac{VREF1}{Rex} \times R11 = Iout \times Rsen$$

The above equations can be expressed as:

$$Rex = \frac{VREF1 \times R11}{Iout \times Rsen}$$

Values of the reference voltage VREF1, the first resistor R11, and the sensing resistor Rsen are predetermined values on manufacturing the DC-DC converter 80 which is implemented using an IC chip, and the user can adjust the current value which the sensing circuit unit 200 determines as abnormal, by changing only the resistance value of the external resistor Rex connected to the resistor coupling terminal CR.

For example, if the reference voltage VREF1 is set to 1V, the first resistor R11 is set to 7.5KΩ, the sensing resistor Rsen is set to 1Ω, and the external resistor Rex of 7.5KΩ is coupled to the DC-DC converter 80, then the comparator 220 can output the driving stop signal Fst to the first switching control unit 115 of the first power generation unit 110 once value of the current Tout flowing in the sensing resistor Rsen is 1 A.

The first switch control unit 115 to which the driving stop signal Fst is input can stop the driving of the first power generation unit 110 by turning-off both transistors M4 and M5 included in the first power generation unit 110.

Figure 5:
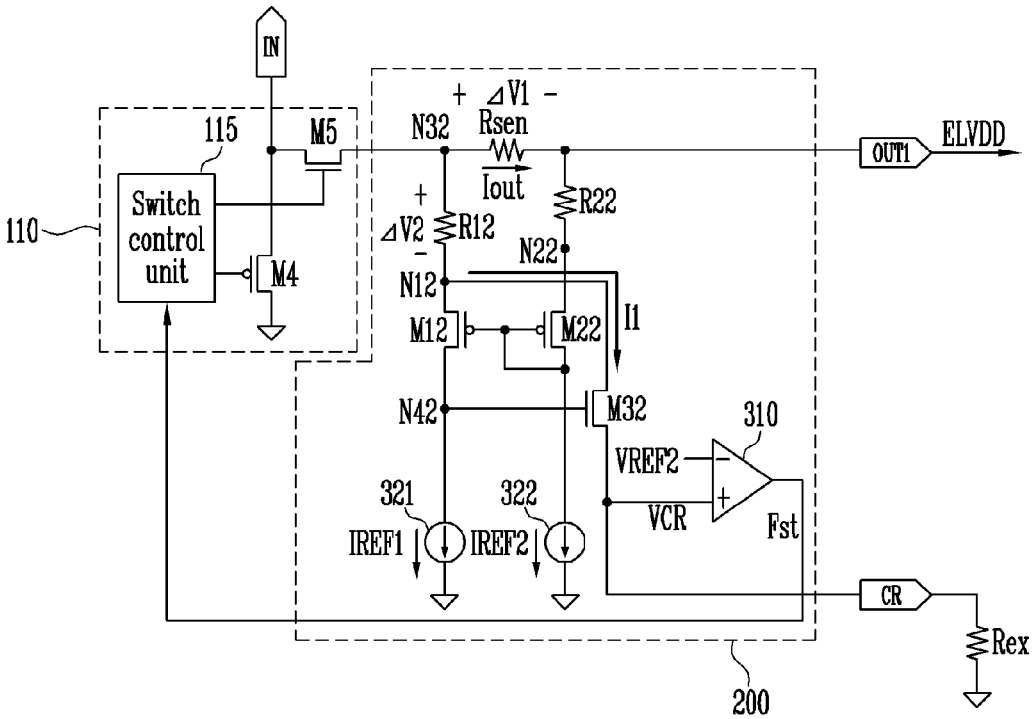
FIG. 5 is a diagram illustrating another embodiment of the sensing circuit unit shown in FIG. 3.

FIG. 5 is a diagram illustrating another embodiment of the sensing circuit unit shown in FIG. 3.

Referring to FIG. 5, another embodiment of the sensing circuit unit 200 includes the sensing resistor Rsen, a first resistor R12, a second resistor R22, a first transistor M12, a second transistor M22, a third transistor M32, a comparator 310, a first reference current source 321, and a second reference current source 322.

The sensing resistor Rsen is placed between the first power generation unit 110 and the output OUT1 of the DC-DC converter 80. Specifically, the sensing resistor Rsen is coupled to the fifth transistor M5 included in the first power generation unit 110.

The first resistor R12 is connected between a third node N32, which is a common node between the first power generation unit 110 and the sensing resistor Rsen, and the first node N12.

The first transistor M12 is connected between the first node N12 and the first reference current source 321. The source electrode of the first transistor M12 is connected to the first node N12, and the drain electrode of the first transistor M12 is connected to the first reference current source 321.

The second resistor R22 is connected between the output terminal OUT1 of the DC-DC converter 80 and the second node N22. In some embodiments, the second resistor R22 has the same resistance value as the first resistor R12.

The second transistor M22 is connected between the second node N22 and the second reference current source 322.

The gate electrode of the first transistor M12 and the gate electrode of the second transistor M22 may be coupled to each other, and the gate electrode of the second transistor M22 may be coupled to the second reference current source 322.

The source electrode of the second transistor M22 can be connected to the second node N22, the drain electrode of the second transistor M22 can be connected to the second reference current source 322, and the gate electrode of the second transistor M22 can be connected to the drain electrode of the second transistor M22.

Accordingly, the first transistor M12 and the second transistor M22 can be configured as a current mirror.

The third transistor M32 is connected between the first node N12 and the resistor coupling terminal CR, and the gate electrode thereof is connected to a fourth node N42, which is a common node between the first transistor M12 and the first reference current source 321.

The reference voltage VREF2 and a voltage VCR of the resistor coupling terminal CR are input to the comparator 310, and then if both voltages are identical, the comparator 310 can supply the driving stop signal Fst to the first power generation unit 110.

A first reference current source 321 can be coupled between the first transistor M21 and the ground power, and can generate a first reference current IREF1.

A second reference current source 322 can be coupled between the second transistor M22 and the ground power, and can generate a second reference current IREF2.

In some embodiments, the first reference current IREF1 and the second reference current IREF2 have the same value.

Referring to the circuit configuration of FIG. 5, a first voltage Δ V1 across the sensing resistor Rsen and a second voltage Δ V2 across the first resistor R11 are expressed as follows:

$$\Delta V1 = I\text{out} \times R\text{sen}$$

$$\Delta V2 = (\text{IREF1} + I1) \times R12$$

In addition, the voltage VN12 of the first node N12 corresponds to the difference between the voltage VN32 of the third node N32 and the second voltage Δ V2, and thus can be expressed as:

$$VN12 = VN32 - (\text{IREF1} + I1) \times R12$$

The voltage VN32 of the third node N32 corresponds to the sum of the voltage ELVDD of the output terminal OUT1 and the first voltage Δ V1, and thus can be expressed as:

$$VN12 = \Delta V1 + \text{ELVDD} - (\text{IREF1} + I1) \times R12$$

The voltage VN22 of the second node N22 can be expressed as:

$$VN22 = \text{ELVDD} - \text{IREF2} \times R22$$

If the resistance values of the first resistor R12 and the second resistor R22 are identical, and the current values of the first reference current IREF1 and the second reference current IREF2 are identical, then the first transistor M12 and the second transistor M22 operate as a current mirror circuit, and thus the voltage VN12 of the first node N12 and the voltage N22 of the second node N22 are set to be equal.

Using the conditions that the voltage VN12 of the first node N12 and the voltage N22 of the second node N22 are identical, the following equation is derived:

$$I1 = \frac{\Delta V1}{R12} = \frac{Iout \times Rsen}{R12}$$

If the reference voltage VREF2 and the voltage VCR of the resistor coupling terminal CR are identical, then the comparator 310 outputs the driving stop signal, and thus the following equation can be derived:

$$VCR = I1 \times Rex = VREF2 = \frac{VREF2}{I1} = \frac{VREF2 \times R12}{Iout \times Rsen}$$

Referring to the above equations, because values of the reference voltage VREF2, the first resistor R12, the second resistor R22, and the sensing resistor Rsen are predetermined values upon manufacturing of the DC-DC converter 80 which is implemented using an IC chip, the user can adjust the current value which the sensing circuit unit 200 determines as abnormal, by changing only the resistance value of the external resistor Rex connected to the resistor coupling terminal CR.

For example, if the reference voltage VREF2 is set to 1V, the first resistor R12 and the second resistor R22 is set to 7.5KΩ, the sensing resistor Rsen is set to 1Ω, and the external resistor Rex of 7.5KΩ is coupled to the DC-DC converter 80, then the comparator 310 can output the driving stop signal Fst to the first switching control unit 115 of the first power generation unit 110 once value of the current Tout flowing in the sensing resistor Rsen is 1 A.

The first switch control unit 115 to which the driving stop signal Fst is input can stop the driving of the first power generation unit 110 by turning-off both the transistors M4 and M5 included in the first power generation unit 110.

While the present invention has been described in connection with certain embodiments, it is to be understood that the invention is not limited to the disclosed embodiments, but, on the contrary, is intended to cover various modifications and equivalent arrangements included within the spirit and scope of the appended claims, and equivalents thereof.

What is claimed is:

1. A power supply unit including:

a DC-DC converter including a first power generation unit, an output terminal, a sensing circuit unit between the first power generation unit and the output terminal, and a resistor coupling terminal coupled to the sensing circuit unit, wherein the sensing circuit unit includes a sensing resistor and wherein the first power generation unit includes a switch controller configured to stop driving of the first power generation unit; and an external resistor located outside the DC-DC converter and coupled to the resistor coupling terminal, wherein the first power generation unit is configured to output a current to the output terminal, the sensing circuit unit is configured to cause a stop in operation of the first power generation unit based on a value of a current flowing in the sensing resistor exceeding a predetermined value, wherein the predetermined value is adjustable based on a selected value of the external resistor, and wherein the output terminal is configured to output a first power, wherein the sensing circuit unit further includes:

a first resistor connected to a common node between the first power generation unit and the sensing resistor, and a first node, a first transistor connected to the first node and the resistor coupling terminal, an operational amplifier configured to control the first transistor using a reference voltage and a voltage of the resistor coupling terminal which are input, and a comparator configured to supply a driving stop signal to the switch controller of the first power generation unit if both a voltage of the output terminal and a voltage of the first node are identical.

2. The power supply unit according to claim 1, wherein the operational amplifier comprises a non-inverting terminal with the reference voltage input thereto, an inverting terminal with the voltage of the resistor coupling terminal input thereto, and an output terminal connected to a gate electrode of the first transistor.

3. The power supply unit according to claim 1, wherein the DC-DC converter further includes an input terminal electrically coupled to a power unit.

4. The power supply unit according to claim 3, further comprising a first inductor connected between the power unit and the input terminal.

5. The power supply unit according to claim 4, wherein the first power generation unit includes:

a fourth transistor connected to the input terminal and a ground power, a fifth transistor connected to the input terminal and the sensing resistor, and a first switching control unit configured to control the fourth transistor and the fifth transistor.

6. The power supply unit according to claim 1, wherein the DC-DC converter is implemented by an integrated chip.

7. An organic light emitting display including:

a plurality of pixels supplied with each of a scan signal, a data signal and a first power;

a scan driving unit for supplying the scan signal to the pixels through a scan line;

a data driving unit for supplying the data signal to the pixels through a data line; and a power supply unit including a DC-DC converter including a first power generation unit, an output terminal, a sensing circuit unit between the first power generation unit and the output terminal, a resistor coupling terminal coupled to the sensing circuit unit, and an external resistor located outside the DC-DC converter and coupled to the resistor coupling terminal, the first power generation unit configured to output a current to the output terminal and including a switch controller configured to stop driving of the first power generation unit, the sensing circuit unit including a sensing resistor and configured to cause a stop in operation of the first power generation unit based on a value of a current flowing in the sensing resistor exceeding a predetermined value, wherein the predetermined value is adjustable based on a selected value of the external resistor, the output terminal configured to output the first power, the resistor coupling terminal configured to supply the first power to the pixels, wherein the sensing circuit unit further includes:

a first resistor connected between a common node between the first power generation unit and the sensing resistor, and a first node, a first transistor connected between the first node and the resistor coupling terminal, an operational amplifier configured to control the first transistor using a reference voltage and a voltage of the resistor coupling terminal which are input, and a comparator configured to supply a driving stop signal to the switch controller of the first power generation unit if a voltage of the output terminal and a voltage of the first node are identical.

8. The organic light emitting display according to claim 7, wherein the operational amplifier includes a non-inverting terminal having the reference voltage input thereto, an inverting terminal having the voltage of the resistor coupling terminal input thereto, and an output terminal connected to a gate electrode of the first transistor.

9. The organic light emitting display according to claim 7, wherein the DC-DC converter further includes an input terminal electrically coupled to a power unit.

10. The organic light emitting display according to claim 7, further comprising a first inductor connected between the power unit and the input terminal.

11. The organic light emitting display according to claim 10, wherein the first power generation unit includes:

a fourth transistor connected between the input terminal and a ground power, a fifth transistor connected between the input terminal and the sensing resistor, and a first switching control unit configured to control the fourth transistor and the fifth transistor.

12. The organic light emitting display according to claim 7, wherein the DC-DC converter is implemented by an integrated chip.

* * * * *